US011512555B2

(12) United States Patent
Batson et al.

(10) Patent No.: US 11,512,555 B2
(45) Date of Patent: Nov. 29, 2022

(54) RETRIEVABLE PACKER WITH PUSH ROD RELEASE

(71) Applicant: CNPC USA Corporation, Houston, TX (US)

(72) Inventors: Perry Batson, Houston, TX (US); Jeff Maynard, Angleton, TX (US); Kwami Roberts, Missouri City, TX (US); Israel Torres, Spring, TX (US); Jianpeng Yue, Sugar Land, TX (US); Shaogong Zhu, Heilongjiang (CN); Meng Cai, Heilongjiang (CN); Yongquan Xu, Heilongjiang (CN)

(73) Assignee: CNPC USA Corporation, Houston, TX (US)

( * ) Notice: Subject to any disclaimer, the term of this patent is extended or adjusted under 35 U.S.C. 154(b) by 101 days.

(21) Appl. No.: 17/064,901

(22) Filed: Oct. 7, 2020

(65) Prior Publication Data

US 2022/0106855 A1 Apr. 7, 2022

(51) Int. Cl.

| | |
|---|---|
| ***E21B 23/06*** | (2006.01) |
| ***E21B 33/129*** | (2006.01) |
| ***E21B 33/12*** | (2006.01) |
| *E21B 29/00* | (2006.01) |

(52) U.S. Cl.

CPC ..... *E21B 33/1292* (2013.01); *E21B 23/06* (2013.01); *E21B 33/1208* (2013.01); *E21B 29/00* (2013.01)

(58) Field of Classification Search

CPC .. E21B 33/1208; E21B 33/1292; E21B 29/00; E21B 23/06

See application file for complete search history.

(56) References Cited

U.S. PATENT DOCUMENTS

| | | | |
|---|---|---|---|
| 2,687,775 | A | 8/1954 | Baker |
| 2,999,544 | A | 9/1961 | Conrad et al. |
| 3,398,795 | A | 8/1968 | Elliston |
| 4,469,172 | A | 9/1984 | Clark |
| 4,657,084 | A | 4/1987 | Evans |
| 5,311,938 | A | 5/1994 | Hendrickson |
| 6,691,788 | B1 | 2/2004 | Dearing |
| 9,970,256 | B2 | 5/2018 | Davies et al. |
| 10,016,918 | B2 | 7/2018 | Rochen et al. |
| 2016/0376869 | A1 | 12/2016 | Rochen et al. |
| 2018/0216429 | A1 * | 8/2018 | Dockweiler ..... E21B 33/128 |

* cited by examiner

*Primary Examiner* — D. Andrews

*Assistant Examiner* — Ronald R Runyan

(74) *Attorney, Agent, or Firm* — Craft Chu PLLC; Andrew W. Chu

(57) ABSTRACT

The retrievable packer system includes a packer mandrel, a lock ring, an upper cone, a lower cone, a slip device, a retrieval mandrel, and a plurality of push rods. The lock ring is attached to the packer mandrel, followed by the upper cone, the slip device, the lower cone, and the retrieval mandrel. The lower cone has lower cone rod channels, and the push rods anchored on the retrieval mandrel slide through respective channels toward the upper cone. The packer system is run into the borehole with each rod in the first position relative to a tip end of the lower cone and the slip device in the run-in position. The packer system is set and can be locked at a location in the borehole. Each push rod can push the upper cone to return the slip device to the run-in position for retrieval of the packer system.

20 Claims, 6 Drawing Sheets

RETRIEVABLE PACKER WITH PUSH ROD RELEASE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a retrievable packer system that attaches to and releases from a location in the wellbore. Even more particularly, the present invention relates to a packer system with push rods to release the packer system set at the location in the wellbore for downhole operations from the location in the wellbore, after the downhole operations are completed.

2. Description of Related Art Including Information Disclosed Under 37 CFR 1.97 and 37 CFR 1.98

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone so that the production fluids can be delivered to the production zone and not the non-productive zone. Examples of downhole tools to isolate zones include a plug, a packer or other tool with an isolation valve.

In the conventional process, the packer is run downhole into the wellbore. When at the correct location within the wellbore, the packer is expanded against the walls to be fixed at the location within the wellbore. Slip devices from a retracted position are actuated to an expanded position by cone assemblies. In the expanded position, the slip devices grip the walls of the wellbore to hold the location of the packer. The downhole operations can be performed with the packer fixed at the location. When the downhole operations are completed, the packer must be removed, and retrievable packers are known. There are several methods to release a slip device from the location. Cutting off the slip device or at least a portion of the slip device, forcibly pulling the slip device free, and mechanically separating the slip device from the location with wedges and other levers. There are several methods to release the cone assemblies from the slip devices as well. The cone assemblies exerted the force to expand the slip device for gripping, so separating the cone assemblies from the slip devices removes the support of the slip devices at the location.

Removing or separating the cone assemblies from the slip devices is a known method for releasing the packer for retrieval. There are known snap rings and collet fingers to release cone assemblies from the slip devices. U.S. Pat. No. 6,691,788B1, issued on 17 Feb. 2004 to Dearing, discloses a packer with a collet member to expand and retract slip devices. U.S. Pat. No. 5,311,938, issued on 17 May 1994 to Hendrickson et al, discloses a packer with a lock ring to release the slips from the packer. Snap rings can cause issues due to having a typically small bearing area. If more force is required to disengage the cone assemblies and slip devices, the snap ring breaks and fails to release the slip devices from the location.

Rods or support rods are known components in packer systems. Conventionally, rods have been used as guides to maintain alignment while setting the slip devices. See U.S. Pat. No. 9,970,256, issued on 15 May 2018 to Davies et al., U.S. Pat. No. 4,657,084, issued on 14 Apr. 1987 to Evans, U.S. Pat. No. 4,469,172, issued on 4 Sep. 1984 to Clark, and U.S. Pat. No. 2,999,544, issued on 12 Sep. 1961 to Conrad et al. The rods are functionally shear pins to hold slip devices in place to expand into the proper position. There are respective channels and slots for these rods within the components of the packer. However, rods have not been used in a release mechanism for retrievable packers.

It is an object of the present invention to provide a retrievable packer system to isolate zones in a wellbore for downhole operations.

It is an object of the present invention to provide a retrievable packer system to be set in a location within a wellbore and to be released from the location.

It is another object of the present invention to provide a retrievable packer with push rods to release the packer system from the location.

It is another object of the present invention to provide retrievable packer system having a slip device with a run-in position and set position.

It is still another object of the present invention to provide retrievable packer system having push rods to move the slip device from the set position back to the run-in position.

It is still another object of the present invention to provide retrievable packer system having a lower cone with channels for push rods to move the slip device from the set position back to the run-in position.

It is another object of the present invention to provide retrievable packer system compatible with different amounts of force to return the slip device in the set position back to the run-in position.

It is still another object of the present invention to provide retrievable packer system with different arrangements and numbers of push rods corresponding to the different amounts of force to return the slip device in the set position back to the run-in position.

These and other objectives and advantages of the present invention will become apparent from a reading of the attached specification, drawings and claims.

BRIEF SUMMARY OF THE INVENTION

Embodiments of the present invention include a retrievable packer system that sets and locks at a location within a borehole and also unlocks and releases from the location. The packer system of the present invention includes release components that withstand a greater range of force to release the packer system from the location and reduce the risk of fatal damage to the release components. The packer system includes a packer mandrel, a lock ring, an upper cone, a lower cone, a slip device, a retrieval mandrel, and a plurality of push rods.

The lock ring has both an unlocked position and a locked position on the packer mandrel relative to a lower mandrel end. The locked position is closer to the lower mandrel end than the unlocked position. The lock ring is moveable along the packer mandrel in the unlocked position. The lock ring moves toward the lower mandrel end to lock the packer system at the location.

The slip device has both a run-in position and a set position relative to distance from an outer engagement surface of the slip device to the upper cone and the lower cone. The extended distance of the set position is greater than the initial distance of the run-in position. The extended distance corresponds to the expanded diameter of the slip device to set the packer system at the location within the borehole.

The lock ring and the slip device are related. The slip device sets the packer system at the location, while the lock ring locks the packer system at the location. From a set and locked packer system at the location, the retrieval requires unlocking and releasing. There is interaction to unlock the lock ring so that the slip device can return the run-in position for release.

Embodiments of the lower cone and push rods further disclose the relationships for releasing the packer system from the location within the borehole from the set and locked positions. The lower cone includes a lower cone tip end facing the upper cone, a lower cone base end opposite the lower cone tip end, and a plurality of lower cone rod channels extending through the lower cone. Each push rod is extended into a corresponding lower cone rod channel. The push rods 80 have four positions relative to the lower cone, particularly the lower cone tip end of the lower cone.

FIGS. 1-10 show the four positions of each rod 80.

The packer system is deployed into the borehole with each rod in the first position. The slip device is at the initial distance and does not engage the walls of the borehole so that the packer system can travel through the borehole. Each push rod in a first position relative to the lower cone tip end includes a push end of the push rod within a respective lower cone rod channel of the lower cone.

The packer system is set at the location within the borehole with each rod in the second position. Each push rod has a second position relative to the lower cone tip end with the push end within the respective lower cone rod channel of the lower cone. The second position is closer to the lower cone tip end than the first position. The downhole operations can be performed with the packer system in this set and locked position within the borehole.

Once downhole operations have been completed with the packer system 10 at the location, it is time to retrieve the packer system. Each push rod is transitioned to a third position from the second position. Each push rod has a third position relative to the lower cone tip end with the push end extended from the respective lower cone rod channel of the lower cone and in contact with the upper cone. The third position is extended past the lower cone tip end and out of the lower cone. The push rods are now ready to push the upper cone.

The packer system is released from the location within the borehole with the push rods in the fourth position. The push rods have completed pushing the upper cone away from the lower cone, which slides the slip device back to the run-in position. The packer system is no longer set at the location within the borehole. Each push rod has a fourth position with the push end extended from the respective lower cone rod channel of the lower cone and in contact with the upper cone. The fourth position is farther from the lower cone tip end than the third position. The packer system is now released from the borehole to be retrieved.

Embodiments of the upper cone and the lower cone include respective ramp surfaces cooperative with an inner slip engagement surface of the slip device. The ramp surfaces and inner slip engagement surface determine the initial distance and the extended distance of the outer slip engagement surface for the run-in position and the set position of the slip device.

Embodiments of the retrieval mandrel are comprised of a connection portion, a release portion, and a cut target between the connection portion and release portion. The connection portion must be separated from the release portion in order to move each push rod from the second position to the third position and to move each push rod from the third position to the fourth position. The release portion must disconnect so that the connection portion can be pulled upward with the packer mandrel to move the push rods.

The push rods include alternate embodiments with an attachment portion and an offset portion. The attachment portion can include threaded engagement, snap fit, friction fit, made integral or other known mechanical connection. The offset portion is in abutment against the retrieval mandrel to distributes pressure exerted by the retrieval mandrel between the attachment portion and the offset portion. Not all of the pressure to push the upper cone is placed on the attachment portion. The threads or snap fit structures are no longer solely responsible for exerting the force upward on the upper cone. The amount of force is no longer limited by the strength of attachment structures, like threads, in the attachment portion. Additionally, the arrangement, dimensions and number of push rods can be selected for the amount of force to be applied to release the slip device from the set position back to the run-in position.

The present invention provides a retrievable packer system to isolate zones in a wellbore for downhole operations. The retrievable packer system and method sets the packer system in a location within a wellbore and releases the packer system from the location. The packer system can be set and locked in the location for the performance of a variety of downhole operations. After completion of those operations, the packer system is unlocked and released from the location to be retrieved.

DETAILED DESCRIPTION OF THE INVENTION

Figure 1:
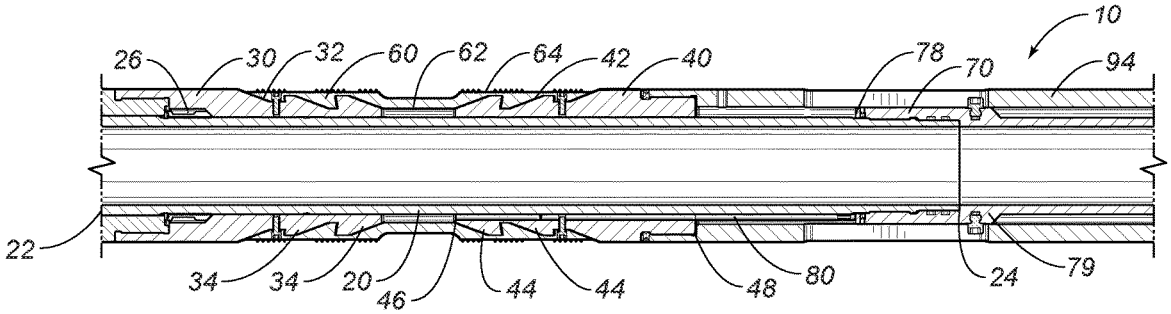
FIG. 1 is a sectional view of an embodiment of the packer system according to the present invention with the lock ring in an unlocked position, the slip device in a run-in position, and each push rod in a first position.

Retrievable packer systems release the slip devices or portions of the slip devices from the wall of the borehole or release the slip devices from cone assemblies so that the cone assemblies no longer support the slip devices against the wall of the borehole. Without the support of the cone assemblies, the slip devices are easier to release from the wall of the borehole. The amount of force for the initial release of the slip devices from the wall or from the cone assemblies can damage the release components being pulled or pressed. Release components, such as snap rings and collet fingers, can break, rendering these release components unable to function. The packer can become no longer retrievable, and more expensive and time consuming equipment and methods are required to remove the packer from its location in the borehole. The retrievable packer system 10 of the present invention includes release components with greater durability to withstand the amount of force to release the slip devices and reduce the risk of fatal damage to the release components.

FIGS. 1-11 show embodiments of a retrievable packer system 10 according to the present invention. The retrievable packer system 10 comprises a packer mandrel 20, a lock ring 26, an upper cone 30, a lower cone 40, a slip device 60, a retrieval mandrel 70, and a plurality of push rods 80. The packer mandrel 20 has an upper mandrel end 22 and a lower mandrel end 24, and the lock ring 26 is attached to the packer mandrel 20 at the upper mandrel end 22. The upper cone 30 is mounted on the packer mandrel 20 between the lock ring 26 and the lower mandrel end 24. The lower cone 40 is mounted on the packer mandrel 20 between the upper cone 30 and the lower mandrel end 24. The slip device 60 is positioned between the upper cone 30 and the lower cone 40 and is in sliding engagement with the upper cone 30 and the lower cone 40. The slip device 60 is comprised of an inner engagement surface 62 facing the upper cone 30 and the lower cone 40 and an outer engagement surface 64 opposite the inner engagement surface 62. The retrieval mandrel 70 is mounted on the packer mandrel 20 between the lower cone 40 and the lower mandrel end 24 and has a rod connection end 78 facing the lower cone 40. Each push rod 80 is mounted to the retrieval mandrel 70, and each push rod is comprised of an anchor end 84 attached to the retrieval mandrel 70 and a push end 82 opposite the anchor end 84.

FIGS. 1, 2, 5, 6, 7, and 10 show the lock ring 26 having an unlocked position on the packer mandrel 20 relative to the lower mandrel end 24. FIGS. 3, 4, 8, and 9 show the lock ring 26 having a locked position relative to the lower mandrel end 24. The locked position is closer to the lower mandrel end 24 than the unlocked position. The lock ring 26 is moveable along the packer mandrel 20 in the unlocked position so the unlocked position can be variable. The lock ring 26 is removably attached to the packer mandrel 20 in the locked position. Conventional locking means, such as friction fit, screw threads or clamps, can be triggered to transition the lock ring 26 between the unlocked position and the locked position.

FIGS. 1, 2, 5, 6, 7, and 10 also show the slip device 60 having a run-in position with the outer engagement surface 64 at an initial distance from the upper cone 30 and the lower cone 40. FIGS. 3, 4, 8, and 9 also show the slip device 60 having a set position with the outer engagement surface 64 at an extended distance from the upper cone 30 and the lower cone 40. The extended distance is greater than the initial distance so as to hold position of the packer mandrel 20 in the wellbore. The extended distance corresponds to the expanded diameter of the slip device 60 to grip the walls of the borehole or wellbore or casing. There can be additional gripping means, such as a textured surface, adhesive, or grit coatings on the outer engagement surface 64 for resilient attachment to the walls. The slip device 60 holds the packer system 10 at the location in the wellbore.

The lock ring 26 and the slip device 60 are related. The lock ring 26 is set from the unlocked position to the locked position, when the slip device 60 is in the set position. Thus, the lock ring 26 holds the slip device 60 with the outer engagement surface 64 at the extended distance to set the packer system 20 in the location in the wellbore. The lock ring 26 must be transitioned from the locked position to the unlocked position before slip device 60 transitions from the set position to the run-in position. Thus, there is an embodiment with the slip device 60 is in the set position with the lock ring 26 in the locked position and in the unlocked position.

Embodiments of FIGS. 1-11 include the lower cone 40 being comprised of a lower cone tip end 46 facing the upper cone 30, a lower cone base end 48 opposite the lower cone tip end 46, and a plurality of lower cone rod channels 50 extending through the lower cone 40. Each push rod 80 is extended into a corresponding lower cone rod channel 50.

FIGS. 1-10 show the four positions of each rod 80.

Figure 2:
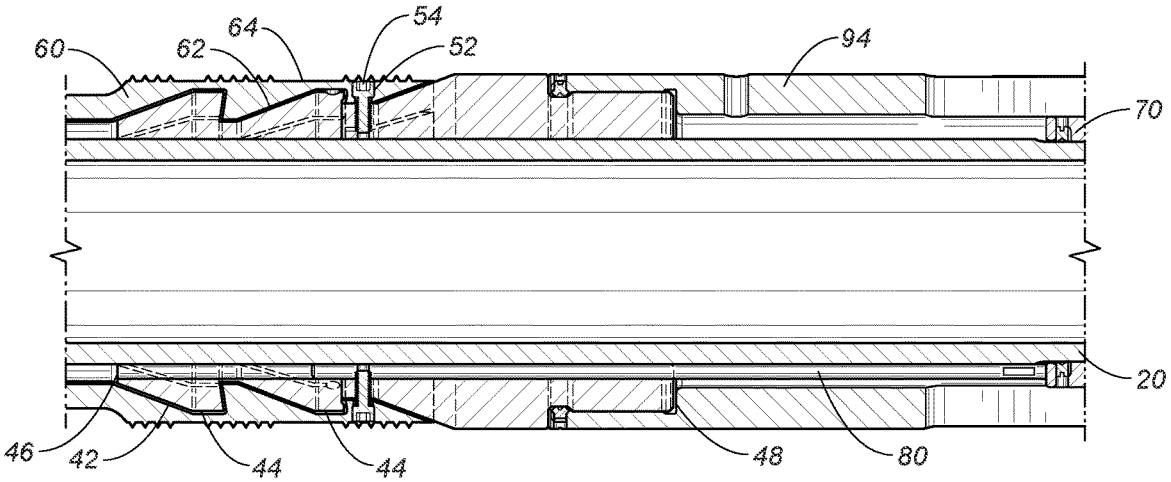
FIG. 2 is an enlarged sectional view of the embodiment in FIG. 1, showing the lower cone and a push rod in the first position.
Figure 7:
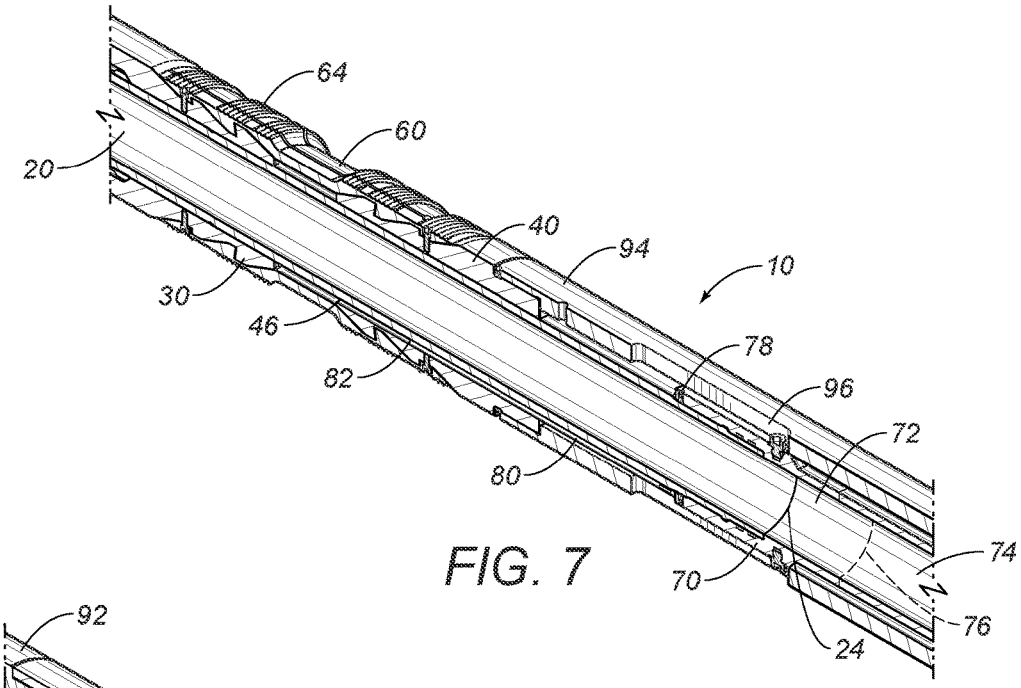
FIG. 7 is a partial sectional and perspective view of the embodiment of FIG. 1, showing the lock ring in an unlocked position, the slip device in a run-in position, and each push rod in the first position.

FIGS. 1, 2 and 7 show each push rod 80 in a first position relative to the lower cone tip end 46 with the push end 82 within a respective lower cone rod channel 50 of the lower cone 40 with slip device 60 in the run-in position. The packer system 10 is deployed into the borehole with each rod in the first position. The slip device 60 is at the initial distance and does not engage the walls of the borehole.

Figure 3:
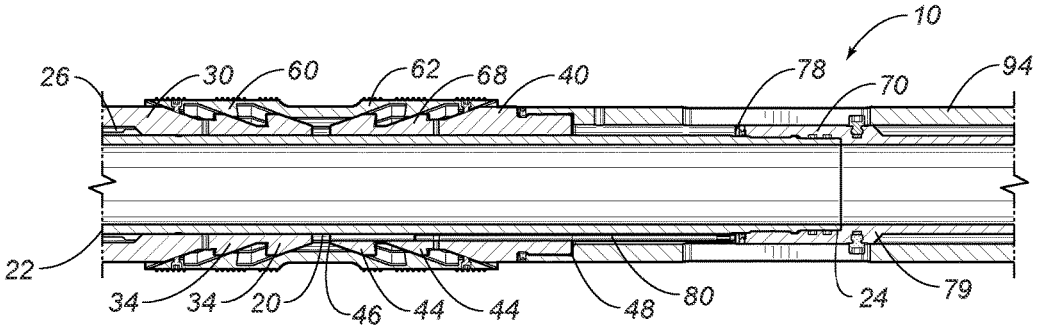
FIG. 3 is a sectional view of an embodiment of the packer system according to the present invention with the lock ring in a locked position, the slip device in a set position, and each push rod in a second position.
Figure 4:
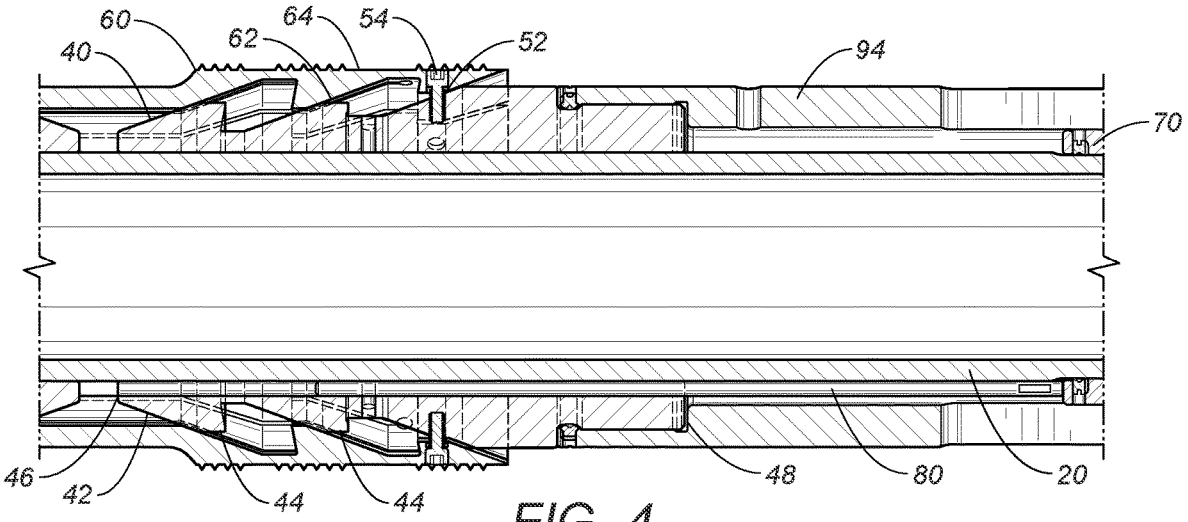
FIG. 4 is an enlarged sectional view of the embodiment in FIG. 3, showing the lower cone and the push rod in the second position.
Figure 8:
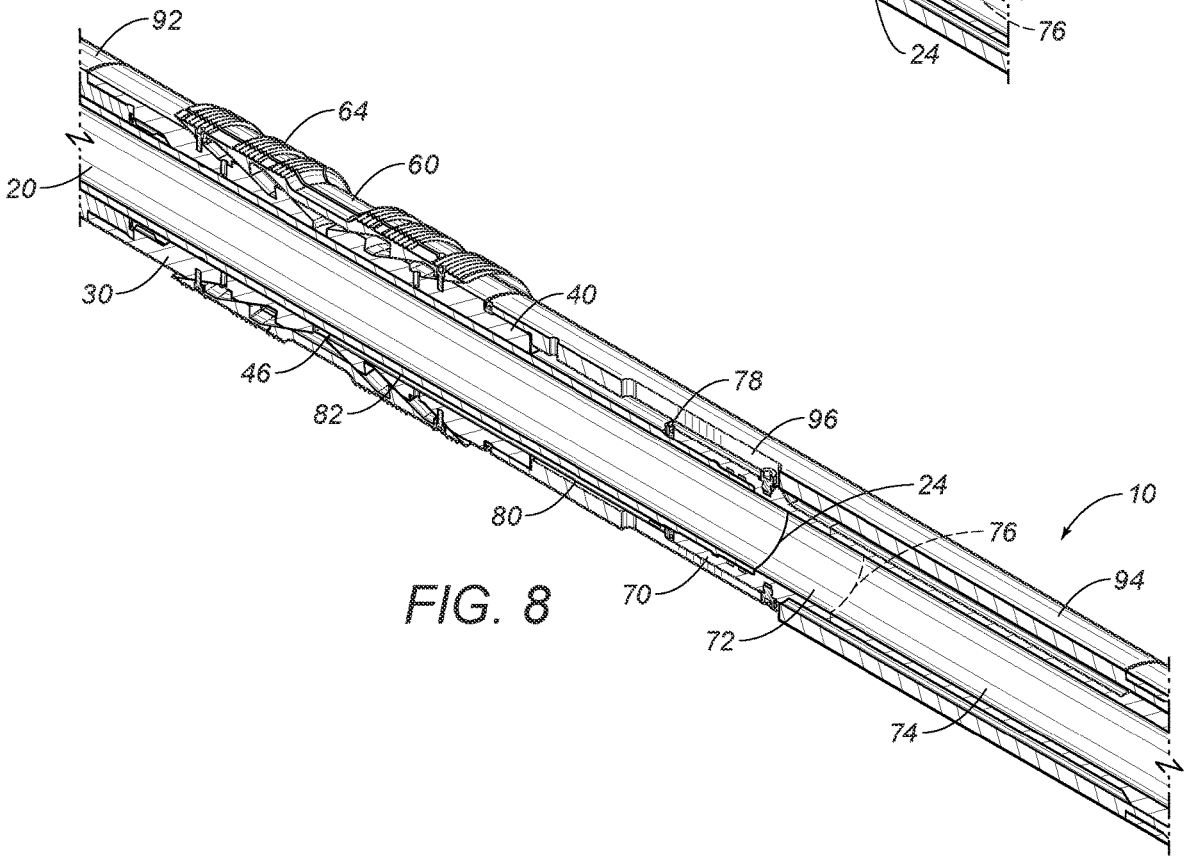
FIG. 8 is a partial sectional and perspective view of the embodiment of FIG. 3, showing the lock ring in a locked position, the slip device in a set position, and each push rod in the second position.

FIGS. 3, 4, and 8 show each push rod 80 having a second position relative to the lower cone tip end 46 with the push end 82 within the respective lower cone rod channel 50 of the lower cone 40 with the slip device 60 in the set position. The second position is closer to the lower cone tip end 46 than the first position. The packer system 10 is attached to the wall of the borehole at a location within the wellbore with each rod in the second position. The slip device 60 is at the extended distance and can be locked at the location with the lock ring 26.

Figure 9:
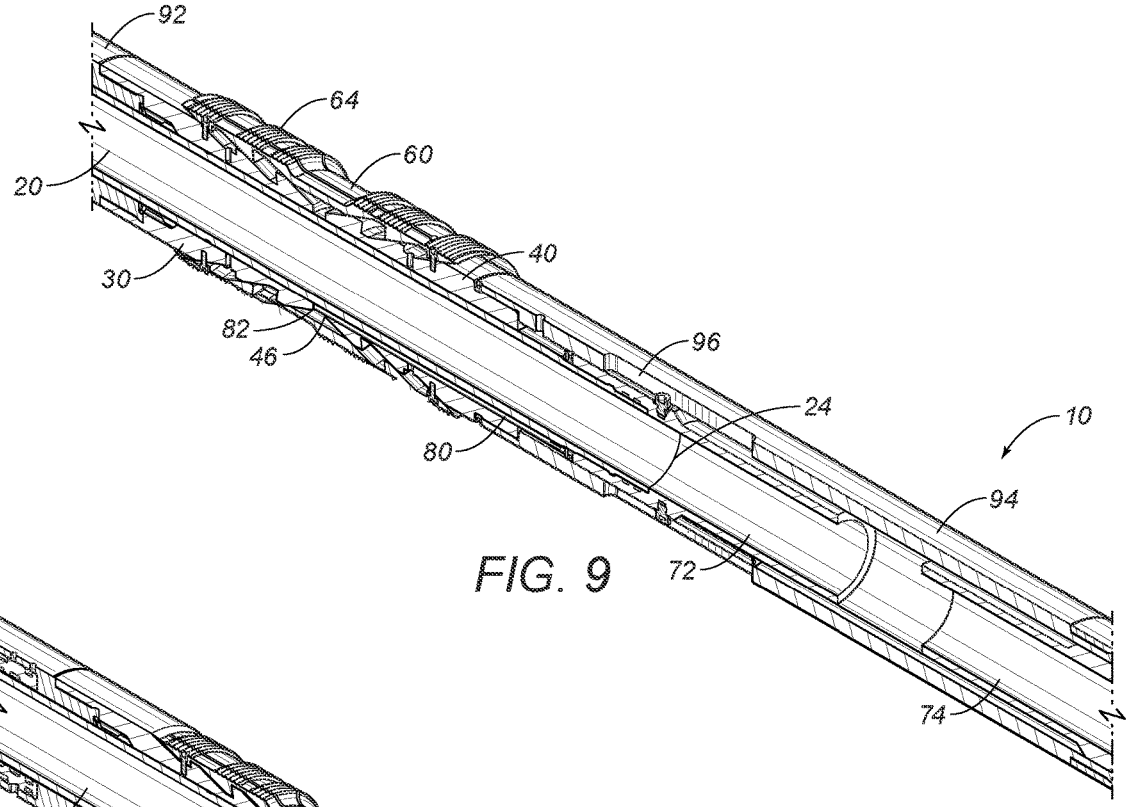
FIG. 9 is a partial sectional and perspective view of an embodiment of the packer system according to the present invention with the lock ring in a locked position, the slip device in a set position, and each push rod in a third position.

FIG. 9 shows each push rod 80 having a third position relative to the lower cone tip end 46 with the push end 82 extended from the respective lower cone rod channel 50 of the lower cone 40 and in contact with the upper cone 30 with the slip device 60 in the set position. The third position is extended past the lower cone tip end 46 and out of the lower cone 40. Once downhole operations have been completed with the packer system 10 at the location, it is time to retrieve the packer system 10. Each push rod 80 is transitioned to the third position from the second position.

Figure 5:
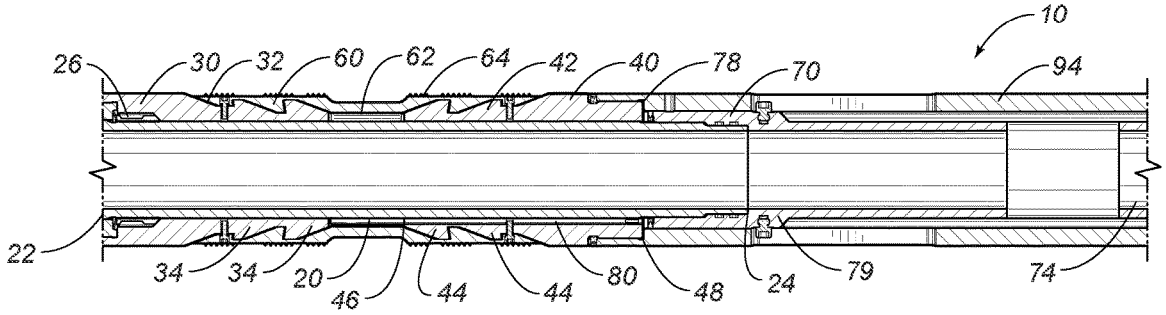
FIG. 5 is a sectional view of an embodiment of the packer system according to the present invention with the lock ring in the unlocked position, the slip device in the run-in position, and each push rod in a fourth position.
Figure 6:
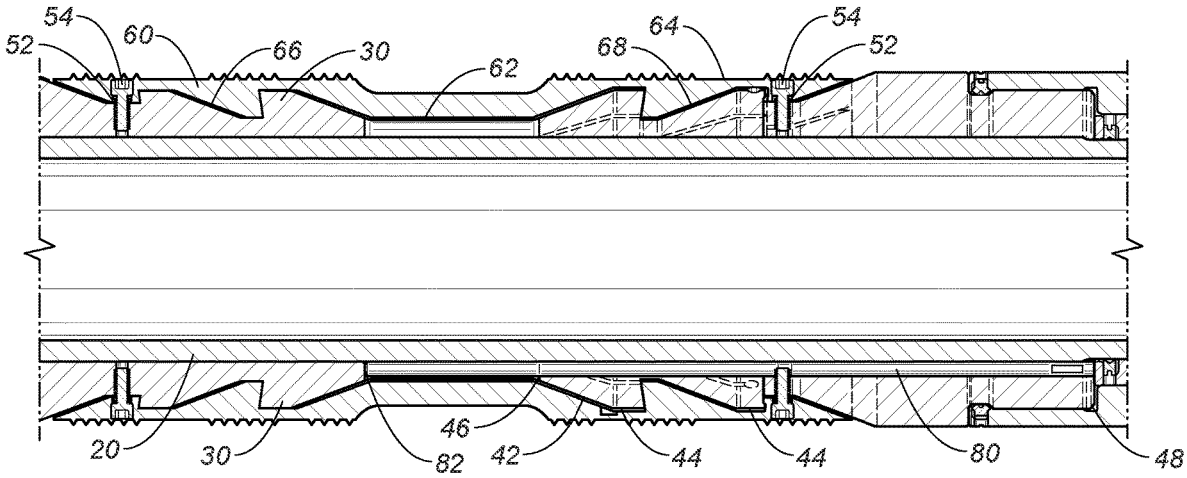
FIG. 6 is an enlarged sectional view of the embodiment in FIG. 5, showing the lower cone and the push rod in the fourth position.
Figure 10:
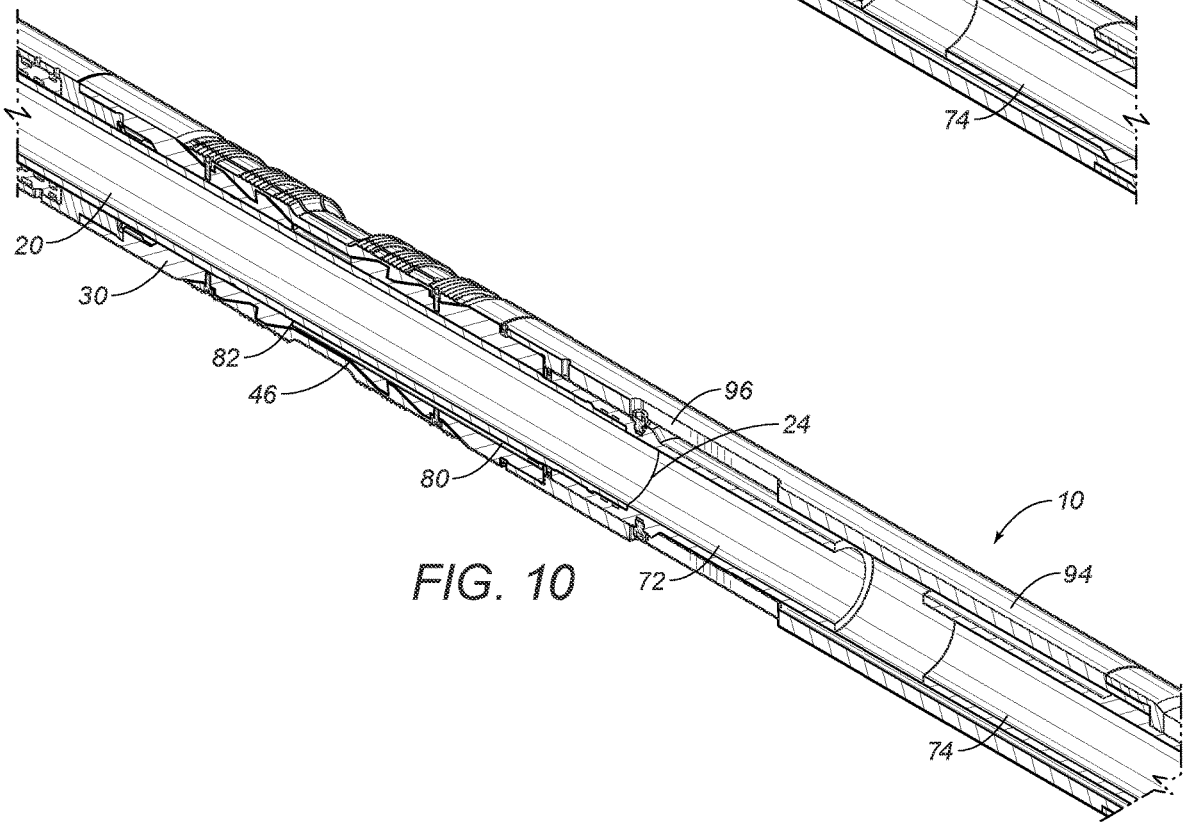
FIG. 10 is a partial sectional and perspective view of the embodiment of FIG. 5, showing the lock ring in the unlocked position, the slip device in the run-in position, and each push rod in the fourth position.

FIGS. 5, 6, and 10 show each push rod 80 having a fourth position with the push end 82 extended from the respective lower cone rod channel 50 of the lower cone 40 and in contact with the upper cone 30 with the slip device 60 in the run-in position. The fourth position is farther from the lower cone tip end 46 than the third position. The push end 82 remains out of the lower cone 40. Each push rod 80 pushes the upper cone 30 off the slip device 60 in the set position so that the slip device 60 slides into the run-in position and the upper cone 30 separates from the lower cone 40. The slip device 60 is returned to the initial distance to release attachment to the wall at the location within the borehole. The packer system 10 is now released from the borehole to be retrieved.

Embodiments of the upper cone 30 and the lower cone 40, include the upper cone 30 being comprised of an upper ramp surface 32 angled outward toward the upper mandrel end 22, and the lower cone 40 being comprised of a lower ramp surface 42 being angled outward toward the lower mandrel end 24. The upper ramp surface 32 can be comprised of at least one conical surface 34, and the lower ramp surface 42 can be comprised of at least one conical surface 44.

The slip device 60 includes embodiments cooperative with the upper ramp surface 32 and the lower ramp surface 42. Embodiments of the slip device include the inner engagement surface 62 being comprised of an upper slip engagement surface 66 in sliding engagement with both the upper ramp surface 32 and a lower slip engagement surface 68 in sliding engagement with the lower ramp surface 42. The slip device 60 is complementary to the ramp surfaces 32, 42 of the respective cones 30, 40. The tops of the conical surfaces 34, 44 engaging complementary conical portions of the upper slip engagement surface 66 and lower slip engagement surface 68 determine the extended distance of the outer engagement surface 64 at the set position of the slip device 60. The top of conical surfaces 34, 44 engaging the gaps between complementary conical portions of the upper slip engagement surface 66 and lower slip engagement surface 68 determine the initial distance of the outer engagement surface 64 at the run-in position of the slip device 60.

Embodiments shown in FIGS. 5 and 8-10 include the retrieval mandrel 70 being comprised of a connection portion 72, a release portion 74, and a cut target 76 between the connection portion 72 and release portion 74. The connection portion 72 has the rod connection end 78. FIGS. 1, 3, and 5 show the connection portion 72 having a greater wall thickness than the release portion 74. FIGS. 1, 3, and 5 further show the retrieval mandrel 70 having a conical section 79 with a diameter increasing from the release portion 74 to the connection portion 72.

The connection portion 72 must be separated from the release portion 74 in order move each push rod 80 from the second position to the third position. The release portion 74 must disconnect so that the connection portion 72 can be pulled upward with the packer mandrel 20 to move the push rods 80. The connection portion 72 of the retrieval mandrel 70 is separated from the release portion 74, when each push rod 80 is in the third position and when each push rod 80 is in the fourth position. The connection portion 72 of the retrieval mandrel 70 is integral with the release portion 74 by the cut target 76, when each push rod 80 is in the first position. The second position is the transition with the cut target 76 being cut with each push rod 80 in the second position.

Figure 11:
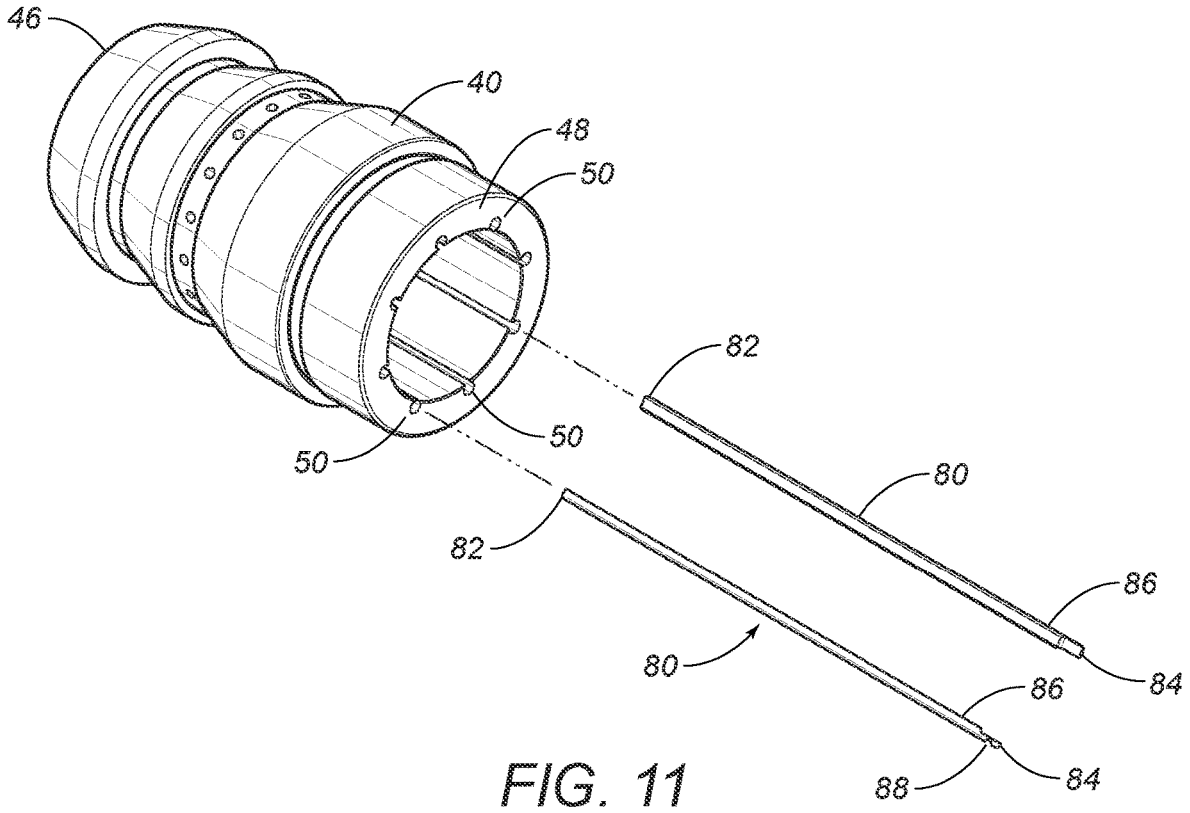
FIG. 11 is an exploded perspective view of embodiments of the push rods and lower cone, according to the present invention.

The push rods 80 include the embodiment shown in FIGS. 1, 3, 5 and 11. Each push rod 80 is fixedly attached to the rod connection end 78. The attachment can be threaded engagement, snap fit, friction fit, made integral or other known mechanical connection. FIG. 11 shows that each push rod can be further comprised an offset portion 86 in abutment against the retrieval mandrel 70 and an attachment portion 88 fixedly attached to the rod connection end 78 of the retrieval mandrel 70. The offset portion 86 distributes pressure. Not all of the pressure to push the upper cone 30 is placed on the attachment portion 80. The threads or snap fit structures are no longer solely responsible for exerting the force upward on the upper cone 30. The amount of force is no longer limited by the strength of attachment structures, like threads, in the attachment portion 88.

FIG. 11 further shows that the dimensions and number of push rods 80 can be selected for the amount of force to be applied to release the slip device 60 from the set position back to the run-in position. FIG. 11 further shows a circumferential arrangement of the push rods 80 around lower cone 40 with the corresponding lower cone rod channels 50 in an analogous arrangement. Not all lower cone rod channels 50 must be filled with push rods 80. The push rods 80 can be equally dispersed around the circumference of the packer mandrel 20, and the number of push rods 80 to be equally dispersed can be varied according to the desired amount of force to be applied to push the upper cone 30.

Additional embodiments of the packer system 10 are shown in FIGS. 7-10. There can be an upper connection sleeve 92 placed on the packer mandrel 20 above the lock ring 26, and a lower connection sleeve 94 placed around the packer mandrel 20 between lower cone 40 and the lower mandrel end 24. The lower connection sleeve 94 can have a sleeve slot 96 with the connection portion 72 of the retrieval mandrel 70 being moveable within the sleeve slot. Each push rod 80 in the first position and the second position corresponds to one end of the sleeve slot 96, while a midpoint in the sleeve slot 96 corresponds to each push rod in the third position and an opposite end of the sleeve slot 96 corresponds to each push rod in the fourth position. The upper connection sleeve 92 and the lower connection sleeve 94 engage the upper cone 30 and lower cone respectively. The pulling from above is on the packer mandrel 20, while the packer mandrel 20 is moveable relative the upper connection sleeve 92 and the lower connection sleeve 94.

More embodiments of the packer system 10 are shown in FIGS. 2, 4 and 6. There can be a plurality of through holes 94 extending through the slip device 60 and into a respective upper cone 30 or lower cone 40, and a plurality of shear screws 96. Each shear screw 96 is placed in a respective through hole 94 through the slip device 60 and into a respective upper cone 30 or lower cone 40 in the run-in position of the slip device 60 as in FIG. 2. A corresponding push rod 80 in the first position can also have a reception hole 98. In this embodiment, the shear screw 96 removably engages the push rod 80 at the reception hole 98, the lower cone 40 and the slip device 60. Each shear screw 96 can be sheared from the respective upper cone 30 or lower cone 40 in the set position of the slip device 60 as in FIGS. 3 and 4.

Embodiments of the present invention include a method for downhole operations with the packer system 10. The method includes running the packer system 10 in a borehole, with the slip device 60 in the run-in position, the lock ring 26 in the unlocked position, and each push rod 80 in the first position as in FIG. 7. The packer system 10 is free to move through the borehole without engaging the walls of the borehole.

The packer system 10 is placed in a location in the wellbore, and the upper cone 30 is moved closer to the lower cone 40 along the packer mandrel 20. The method includes sliding the slip device 60 from the run-in position to the set position and moving each push rod 80 from the first position to the second position concurrent with the step of sliding the slip device 60.

At the set position, the packer system 10 is fixed at the location as in FIG. 8. The lock ring 26 can be transitioned from the unlocked position to the locked position. The packer system 10 is now fixed and locked in the location so as to hold the packer system 10 with the slip device 60 in the set position and each rod 80 in the second position. Downhole operations, such as injecting, producing, fracking, and others, can be performed with the packer system 10 fixed and locked in the location.

Once downhole operations are completed, the method includes moving each push rod 80 from the second position to the third position with the slip device 60 starting in the set position and each push rod 80 starting in the second position.

With the push rods 80 at the third position as in FIG. 9, the method includes transitioning the lock ring 26 from the locked position to the unlocked position. The upper cone 30 is now free to move along the packer mandrel 20. Each push rod 80 now moves from the third position to the fourth position.

The method includes pushing the upper cone 30 further from the lower cone 40 along the packer mandrel 20 concurrent with the step of moving each push rod 80 from the third position to the fourth position. The slip device 60 slides from the set position to the run-in position so as to release the packer system 10 from the location as each push rod 80 reaches the fourth position. The method now includes retrieving the packer system 10 with the slip device 60 in the run-in position and with each push rod in the fourth position as in FIG. 10.

Embodiments of the method include applying pressure from above the lock ring 26 in the step of moving the upper cone 30 closer to the lower cone 40 along the packer mandrel 20. As shown in FIGS. 7 and 8, the packer system 10 can be further comprised an upper connection sleeve 92 placed on the packer mandrel 20 above the lock ring 26, so that the step of applying pressure to the packer system 10 is comprised of the step of applying pressure with the upper sleeve 92 on the lock ring 26 and the upper cone 30.

In another alternative embodiment, the step of moving each push rod 80 from the third position to the fourth position further comprises the steps of: separating the connection portion 72 from the release portion 74 at the cut target 76 of the retrieval mandrel 70; and pulling the packer mandrel 20 without the release portion 74 towards the upper cone 30. The step of separating the connection portion 72 comprises the steps of: deploying a cutting tool to the cut target 76; and cutting the retrieval mandrel 70 at the cut target 76. The second position is an important transition. In the second position, the connection portion 72 can be separated or made integral with the release portion 74 of the retrieval mandrel 70. Each push rod 80 can reach the third position of FIG. 9 after those transitions from the second position.

The lock ring 26 can already be in both the locked position and the unlocked position with each push rod 80 in the second position. The lock ring 26 can also be in both the locked position and the unlocked position with each push rod 80 in the third position. However, the lock ring 26 must transition into the unlocked position for the push rods 80 to move to from the third position to the fourth position. The upper cone 30 must be released to move. The lock ring 26 must be in the unlocked position with the push rods in the fourth position.

The method further includes the steps of pulling the packer mandrel 20 towards the upper cone 30 again and pushing the upper cone 30 with the push rods 80 until the push rods 80 reach the fourth position. The step of moving each push rod from the third position to the fourth position further comprises a step of pulling the packer mandrel 20 without the release portion 74 further towards the upper cone. The step of pushing the upper cone 30 further from the lower cone 40 is comprised of the step of pushing the upper cone 30 with the push rods 80.

The present invention provides a retrievable packer system to isolate zones in a wellbore for downhole operations. The retrievable packer system and method sets the packer system in a location within a wellbore and releases the packer system from the location. The packer system can be set and locked in the location for the performance of a variety of downhole operations. After completion of those operations, the packer system releases from the location to be retrieved.

The packer system has push rods and lower cone rod channels as release components. The push rods are cooperative with the lower cone and retrieval mandrel to push the upper cone and return the slip device to the run-in position from the set position. Once the release portion of the retrieval mandrel is separated, the packer mandrel can be pulled upward without the release portion. The connection portion pulls upward along with the packer mandrel to bring the push rods to the third position in abutment with the upper cone. Once the lock ring is switched from the locked position to the unlocked position, the upper cone is free to move. As the packer mandrel can be pulled further upward, the push rods push the upper cone further away, which slides the slip device back into the run-in position.

The push rods and lower cone rod channels are compatible with different amounts of force to return the slip device in the set position back to the run-in position. Each push rod can be offset so that the attachment portion of the push rod is not solely responsible for exerting force on the upper cone. The structures, like threads, are no longer the mechanical limitation for the amount of force to be exerted against the upper cone to slide the slip device back into the run-in position. The dimension of the offset can further affect the amount of force to be exerted. Additionally, there are different arrangements and numbers of push rods corresponding to the different amounts of force to return the slip device in the set position back to the run-in position. The push rods and corresponding channels can be circumferentially arranged around the lower cone. Any number of push rods can be evenly distributed around the lower cone for the most balanced force exerted on the upper cone. The present invention avoids the fragility of other release components and increases the amount of force available to push the upper cone for the retrieval of the packer system.

The foregoing disclosure and description of the invention is illustrative and explanatory thereof. Various changes in the details of the illustrated structures, construction and method can be made without departing from the true spirit of the invention.

We claim:

1. A retrievable packer system, comprising:

a packer mandrel having an upper mandrel end and a lower mandrel end;

a lock ring being attached to said packer mandrel at said upper mandrel end and having an unlocked position on said packer mandrel relative to said lower mandrel end and a locked position relative to said lower mandrel end, said locked position being closer to said lower mandrel end than said unlocked position, said lock ring being removably attached to said packer mandrel at said locked position;

an upper cone mounted on said packer mandrel between said lock ring and said lower mandrel end;

a lower cone mounted on said packer mandrel between said upper cone and said lower mandrel end, wherein said lower cone is comprised of:

a lower cone tip end facing said upper cone;

a lower cone base end opposite said lower cone tip end; and a plurality of lower cone rod channels extending through said lower cone;

a slip device being between said upper cone and said lower cone and being in sliding engagement with said upper cone and said lower cone, wherein said slip device is comprised of an inner engagement surface facing said upper cone and said lower cone and an outer engagement surface opposite said inner engagement surface, and wherein said slip device has a run-in position with said outer engagement surface at an initial distance from said upper cone and said lower cone and a set position with said outer engagement surface at an extended distance from said upper cone and said lower cone, said extended distance being greater than said initial distance so as to hold position of said packer mandrel in a borehole;

a retrieval mandrel being mounted on said packer mandrel between said lower cone and said lower mandrel end and having a rod connection end facing said lower cone; and a plurality of push rods, each push rod being mounted to said retrieval mandrel and extended into a corresponding lower cone rod channel, and each push rod being comprised of an anchor end attached to said retrieval mandrel and a push end opposite said anchor end, wherein each push rod has a first position relative to said lower cone tip end with said push end within a respective lower cone rod channel of said lower cone with slip device in said run-in position, wherein each push rod has a second position relative to said lower cone tip end with said push end within a respective lower cone rod channel of said lower cone with said slip device in said set position, said second position being closer to said lower cone tip end than said first position, wherein each push rod has a third position relative to said lower cone tip end with said push end extended from said respective lower cone rod channel of said lower cone and in contact with said upper cone with said slip device in said set position, said third position being extended past said lower cone tip end, and wherein each push rod has a fourth position with said push end extended from said respective lower cone rod channel of said lower cone and in contact with said upper cone with said slip device in said run-in position, said fourth position being farther from said lower cone tip end than said third position.

2. The packer system, according to claim 1, wherein said upper cone is comprised of an upper ramp surface angled outward toward said upper mandrel end, and wherein said lower cone is comprised of a lower ramp surface angled outward toward said lower mandrel end.

3. The packer system, according to claim 2, wherein said upper ramp surface is comprised of at least one upper conical surface, and wherein said lower ramp surface is comprised of at least one lower conical surface.

4. The packer system, according to claim 1, wherein said inner engagement surface is comprised of an upper slip engagement surface in sliding engagement with said upper ramp surface and a lower slip engagement surface in sliding engagement with said lower ramp surface, wherein said outer engagement surface is at said initial distance from said upper ramp surface and said lower ramp surface in said run-in position, and wherein said outer engagement surface is at said extended distance from said upper ramp surface and said lower ramp surface.

5. The packer system, according to claim 1, wherein said retrieval mandrel is comprised of a connection portion, a release portion, and a cut target between the connection portion and release portion, said connection portion being comprised of said rod connection end.

6. The packer system, according to claim 5, wherein said connection portion has a greater wall thickness than the release portion.

7. The packer system, according to claim 6, wherein each push rod is fixedly attached to said rod connection end.

8. The packer system, according to claim 5, wherein said connection portion of said retrieval mandrel is separated from said release portion, when each rod is in said third position, wherein said connection portion of said retrieval mandrel is separated from said release portion, when each rod is in said fourth position, and wherein said connection portion of said retrieval mandrel is made integral with said release portion by said cut target, when each rod is in said first position.

9. The packer system, according to claim 1, wherein each anchor end is comprised of an offset portion in abutment against said retrieval mandrel and an attachment portion fixedly attached to said retrieval mandrel.

10. The packer system, according to claim 1, wherein said push rods are arranged circumferentially around said lower cone in corresponding lower cone rod channels.

11. The packer system, according to claim 1, further comprising:

an upper connection sleeve placed on said packer mandrel above said lock ring; and a lower connection sleeve placed around said packer mandrel between lower cone and said lower mandrel end.

12. The packer system, according to claim 1, further comprising:

a plurality of through holes extending through said slip device and into a respective upper cone or lower cone; and a plurality of shear screws, wherein each shear screw is placed in a respective through hole through said slip device and into a respective upper cone or lower cone in said run-in position of said slip device, and wherein each shear screw is sheared in said respective through hole in said set position of said slip device.

13. The packer system, according to claim 12, wherein each shear screw placed in the respective through hole through said slip device and into said lower cone removably engages a corresponding push rod, said slip device being in said run-in position.

14. The packer system, according to claim 13, wherein each corresponding push rod is in said first position.

15. A method for downhole operations, comprising the steps of:

running a packer system, according to claim 1, in a borehole, with said slip device in said run-in position, said lock ring in said unlocked position, and each push rod in said first position;

placing said packer system at a location in the wellbore;

moving said upper cone closer to said lower cone along said packer mandrel;

sliding said slip device from said run-in position to said set position;

moving each push rod from said first position to said second position concurrent with the step of sliding said slip device;

transitioning said lock ring from said unlocked position to said locked position with said packer system at said location so as to hold said packer system with said slip device in said set position and with each push rod in said second position;

moving each push rod from said second position to said third position, said slip device being in said set position with each push rod in said second position;

transitioning said lock ring from said locked position to said unlocked position with said packer system at said location and with each push rod in said third position;

moving each push rod from said third position to said fourth position;

pushing said upper cone further from said lower cone along said packer mandrel concurrent with the step of moving each push rod from said third position to said fourth position;

sliding said slip device from said set position to said run-in position so as to release said packer system from said location; and retrieving said packer system with said slip device in said run-in position and with each push rod in said fourth position.

16. The method, according to claim 15, wherein the step of moving said upper cone closer to said lower cone along said packer mandrel comprises a step of applying pressure to said packer system from above said lock ring.

17. The method, according to claim 16, wherein said packer system further comprises an upper connection sleeve placed on said packer mandrel above said lock ring, and wherein the step of applying pressure to said packer system is comprised of the step of applying pressure with said upper sleeve on said lock ring and said upper cone.

18. The method, according to claim 15, wherein the step of moving each push rod from said second position to said third position further comprises the steps of:

separating said connection portion from said release portion at said cut target; and pulling said mandrel without said release portion towards said upper cone.

19. The method, according to claim 18, wherein the step of separating said connection portion comprises the steps of:

deploying a cutting tool to said cut target; and cutting said retrieval mandrel at said cut target.

20. The method, according to claim 18, wherein the step of moving each push rod from said third position to said fourth position further comprises a steps of pulling said packer mandrel without said release portion further towards said upper cone, and wherein the step of pushing said upper cone further from said lower cone is comprised of a step of pushing said upper cone with said push rods.

* * * * *